US007752861B2

(12) United States Patent
Ishihara et al.

(10) Patent No.: US 7,752,861 B2
(45) Date of Patent: Jul. 13, 2010

(54) OUTDOOR UNIT OF AIR CONDITIONER

(75) Inventors: Hiroki Ishihara, Sakai (JP); Hiromune Matsuoka, Sakai (JP); Toshiaki Mukaidani, Sakai (JP); Tadashi Sao, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 941 days.

(21) Appl. No.: 10/494,439

(22) PCT Filed: Jun. 27, 2003

(86) PCT No.: PCT/JP03/08253

§ 371 (c)(1),
(2), (4) Date: Apr. 30, 2004

(87) PCT Pub. No.: WO2004/005804

PCT Pub. Date: Jan. 15, 2004

(65) Prior Publication Data

US 2005/0000239 A1 Jan. 6, 2005

(30) Foreign Application Priority Data

Jul. 5, 2002 (JP) ..... 2002-197065
Nov. 6, 2002 (JP) ..... 2002-322379

(51) Int. Cl.
*F25D 23/12* (2006.01)

(52) U.S. Cl. ..... 62/262; 248/676; 248/678; 248/237; 52/39

(58) Field of Classification Search ..... 62/262, 62/263, 259.1; 248/676, 677, 678, 188.8, 248/237; 52/39
See application file for complete search history.

(56) References Cited

U.S. PATENT DOCUMENTS

| | | | | | |
|---|---|---|---|---|---|
| 1,741,961 | A | * | 12/1929 | Stein et al. | 108/50.11 |
| 4,470,271 | A | * | 9/1984 | Draper et al. | 62/259.1 |
| 4,989,826 | A | * | 2/1991 | Johnston, Jr. | 248/676 |
| 5,228,311 | A | * | 7/1993 | Erdmann et al. | 62/389 |
| 6,487,870 | B2 | * | 12/2002 | Paxton | 62/259.1 |

FOREIGN PATENT DOCUMENTS

| | | | |
|---|---|---|---|
| JP | 56-90669 | U1 | 7/1981 |
| JP | 60-101663 | U | 7/1985 |
| JP | 61-091765 | U | 6/1986 |
| JP | 63-22321 | Y2 | 6/1988 |
| JP | 1-116330 | U | 8/1989 |
| JP | 4-57135 | U1 | 5/1992 |
| JP | 4-82627 | U1 | 7/1992 |
| JP | 5-42935 | U | 6/1993 |
| JP | 10-132407 | A | 5/1998 |
| JP | 2001-304624 | A | 10/2001 |
| JP | 2001-355875 | A | 12/2001 |

* cited by examiner

*Primary Examiner*—Frantz F. Jules
*Assistant Examiner*—Azim Rahim
(74) *Attorney, Agent, or Firm*—Global IP Counselors

(57) ABSTRACT

The present invention includes foundation legs of an outdoor unit that are made of a relatively thin plate material, and can reduce cost. This outdoor unit includes a compressor, an outdoor refrigerant circuit that includes pipes and a heat exchanger, a case that houses the refrigerant circuit, and a plurality of supports provided so that they protrude downward from the bottom part of the case. Furthermore, foundation legs are provided at the lower ends of the plurality of supports for fixing such, so that they extend towards the inner side of the case.

8 Claims, 5 Drawing Sheets

OUTDOOR UNIT OF AIR CONDITIONER

FIELD OF THE INVENTION

The present invention relates to an air conditioner outdoor unit, and more particularly relates to an air conditioner outdoor unit having a plurality of foundation legs for fixing such.

RELATED ART

As an example of an air conditioner, there is known a so-called multi-type air conditioner for buildings wherein a plurality of indoor units are connected to one outdoor unit. In such an apparatus, the outdoor unit is generally installed on the roof of the building, and temperature-controlled air is supplied from this outdoor unit to an indoor unit provided in each room of the building.

The outdoor unit in a conventional air conditioner has a rectangular parallelepiped-shaped case, a heat exchanger is provided at the upper part inside the case, and a compressor and other constituent parts are provided at the lower part inside the case. Further, a fan and a motor for driving this fan are provided at the upper surface of the case.

As discussed earlier, such an outdoor unit is installed on the roof of a building, and the like; for installation purposes, a plurality of flange-shaped foundation legs that protrude outward are installed at the bottom part of the case. Further, by fixing these foundation legs to a concrete part of the building by chemical anchors and the like, the entire outdoor unit is fixed (e.g., refer to Japanese Patent Application Kokai No. H10-132407).

In a conventional outdoor unit, a plurality of foundation legs is provided at the bottom part of the case so that they protrude outward, as discussed earlier. Because these foundation legs protrude further outward from the outer perimeter of the case, there are cases in which the outdoor unit easily contacts other members during transport, and impacts the ground and the like when dropped. Accordingly, the foundation legs in a conventional apparatus require strength above the strength needed for normal fixing, and are usually made of a relatively thick steel plate. This consequently hinders reducing costs. This situation applies not only to multi-type outdoor units for buildings, but also for outdoor units used in air conditioners for homes.

DISCLOSURE OF THE INVENTION

It is an object of the present invention to enable the foundation legs of the outdoor unit to be constructed with relatively thin plate members, and therefore to enable a reduction in cost.

It is another object of the present invention to improve working efficiency when installing an outdoor unit.

In a first aspect of the present invention, the air conditioner outdoor unit comprises an outdoor refrigerant circuit that includes a compressor, pipes, and a heat exchanger; a case that houses the refrigerant circuit; and a plurality of supports provided so that they protrude downward from the bottom part of the case. Further, foundation legs are provided at the lower ends of the plurality of supports for fixing such, so that they extend toward the inner side of the case.

The outdoor unit is installed by fixing a foundation leg provided at the lower end of a plurality of supports to a member on the fixed side. For example, in a multi-type outdoor unit for buildings, the foundation legs are fixed to a concrete part on the roof of the building by chemical anchors and the like, and the entire unit is thereby fixed.

Herein, the foundation leg is formed into, for example, a flange shape, the same as conventionally; however, because it is provided at the lower end part of the support so that it extends toward the inner side of the case, in cases such as if colliding with members on the opposite side or if being dropped during transport or installation of the outdoor unit, the support positioned more on the outside than the foundation leg contacts the opposite member or the ground first. In other words, the foundation leg is protected by the support and the like; accordingly, the foundation leg can be made of a thinner plate than conventionally, and costs can be reduced.

In a second aspect of the present invention, the air conditioner outdoor unit is the outdoor unit as recited in the first aspect, wherein the plurality of supports are provided extending in the vertical direction at a plurality of locations on the peripheral part of the case; and the plurality of foundation legs are formed by bending a portion of the lower end part of each of the supports.

In the outdoor unit, the foundation legs are formed by bending a portion of the lower end part of each support, i.e., as an integrated unit with the support. Consequently, it can be constructed at a lower cost compared to the case in which a separate member is fixed to the support by welding and the like.

In a third aspect of the present invention, the air conditioner outdoor unit is the outdoor unit as recited in the first aspect or the second aspect, wherein the case has a rectangular cross section; and the plurality of supports are provided at the four corners of the case, and foundation legs, which are provided on two supports each provided along one prescribed side of the case, are provided extending so that they mutually oppose and mutually approach one another.

Herein, if the four foundation legs are, for example, all oriented in different directions, it is necessary when performing the work of fixing the four foundation legs to work facing each of the side surfaces of the case, respectively. However, in the present outdoor unit, the foundation legs of two supports provided along one side of the case extend so that they mutually oppose and approach one another. Accordingly, the work of fixing two of the four foundation legs can be performed if positioned facing one side surface of the case; ultimately, the work of fixing all four of the foundation legs can be performed from two locations.

In a fourth aspect of the present invention, the air conditioner outdoor unit comprises: a case having a plurality of vertical strength parts extending substantially vertically, and that houses an outdoor refrigerant circuit that includes a compressor, pipes, and a heat exchanger; and a plurality of foundation fixed parts provided below the case to fix the case to the installation location. The vertical strength parts extend downward to the height position of the surface wherein the foundation fixed parts are fixed to the installation location. The region formed by the linking of the plurality of foundation fixed parts is included, viewed in a plan view, in the region formed by linking the outer parts of the lower ends of the plurality of vertical strength parts.

The present outdoor unit is installed by fixing to a foundation surface of the installation location a plurality of foundation fixed parts provided below the case. For example, in a multi-type outdoor unit for buildings, the foundation fixed parts are fixed to a concrete part on a roof of a building and the like by anchors and the like, and the entire unit is thereby fixed.

Herein, the plurality of foundation fixed parts are provided so that the region formed by linking the plurality of foundation fixed parts is included, viewed in a plan view, in the region formed by linking the outer parts of the lower ends of the plurality of vertical strength parts; consequently, in cases such as if colliding with the foundation surface and the like or if being dropped during transport or during installation of the outdoor unit, the vertical strength part positioned more on the outside than the foundation fixed part contacts the foundation surface or the ground first. In other words, the foundation fixed part is protected by the vertical strength part; accordingly, the foundation fixed part can be made of a thinner plate than conventionally, and costs can be reduced.

In a fifth aspect of the present invention, the air conditioner outdoor unit is the outdoor unit as recited in the fourth aspect, wherein the foundation fixed parts are fixed to the bottom part of the case.

In the present outdoor unit, because the foundation fixed parts are fixed to the bottom part of the case, the positions at which the foundation fixed parts are provided are variously selectable.

In a sixth aspect of the present invention, the air conditioner outdoor unit is the outdoor unit as recited in the fourth aspect or the fifth aspect, wherein the plurality of foundation fixed parts arranged between the vertical strength parts are formed as an integrated member.

In the present outdoor unit, because the plurality of foundation fixed parts arranged between the vertical strength parts are formed as an integrated member, the number of parts can be reduced.

PREFERRED EMBODIMENTS

First Embodiment

Figure 1:
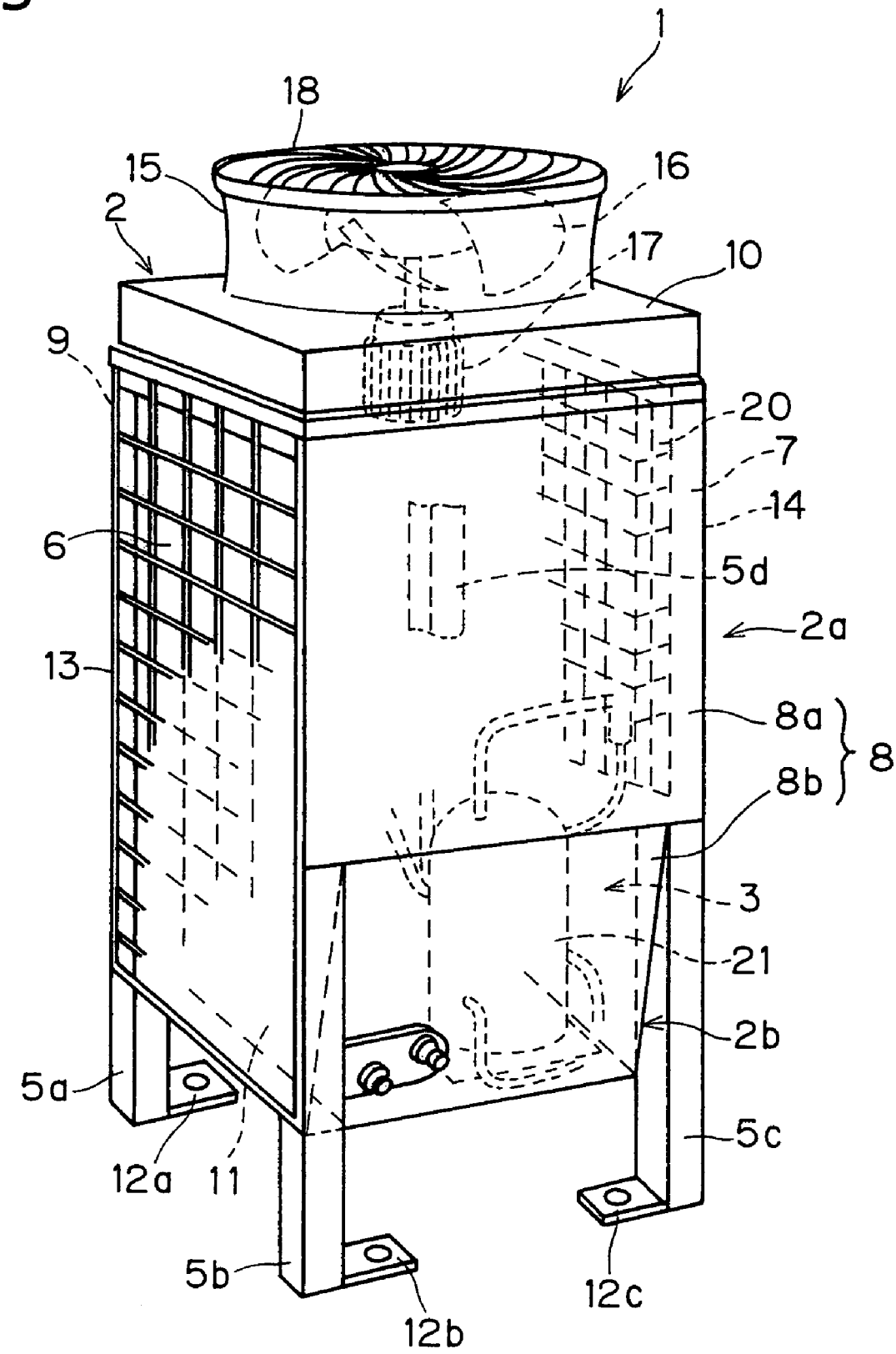
FIG. 1 is an external perspective view of the outdoor unit according to the first embodiment of the present invention.

FIG. 1 depicts an air conditioner outdoor unit 1 according to the first embodiment of the present invention. This outdoor unit 1 is used in a multi-type air conditioning system for a building, and is generally constituted so that it is installed on the roof of the building. In addition, external pipes and the like are omitted from FIG. 1.

(1) Constitution

The outdoor unit 1 has a case 2 that is substantially a rectangular parallelepiped, and an outdoor refrigerant circuit 3 housed inside the case 2.

The case 2 is substantially rectangular parallelepiped-shaped, as discussed earlier. Its cross section is rectangular shaped and it is provided with four supports 5*a*, 5*b*, 5*c*, 5*d* arranged at the four corners, left-right ventilation parts (openings) 6, 7, respectively capable of air inflow, a front plate 8, a rear plate 9, a top plate 10, and a bottom plate 11.

The four supports 5*a*-5*d* each comprise a quadrilateral pipe-shaped member, and the upper end of each support 5*a*-5*d* is fixed to the top plate 10. In addition, each support 5*a*-5*d* extends so that it protrudes further downward from the bottom plate 11 of the case 2; accordingly, it is constituted so that a space is formed below the bottom plate 11 when installing the outdoor unit 1. Further, the lower end of each support 5*a*-5*d* is provided a rectangular-shaped foundation leg 12*a*, 12*b*, 12*c*, 12*d* (the foundation leg 12*d* is not shown in FIG. 1), which are formed by bending a portion thereof toward the inside of the case. Among the foundation legs 12*a*-12*d*, the foundation legs 12*b*, 12*c* of the two supports 5*b*, 5*c* provided along the front plate 8 are formed extending so that they mutually oppose and mutually approach one another; in addition, the foundation legs 12*a*, 12*d* of the other supports 5*a*, 5*d* are likewise formed extending so that they mutually oppose and mutually approach one another. Furthermore, a through hole is formed in each of the foundation legs 12*a*-12*d*, through which a chemical anchor for fixing passes through.

The left-right ventilation parts 6, 7 are openings capable of air inflow from the outside toward the inside of the case 2, and transverse grilles 13, 14 are mounted on the outside thereof.

In addition, the front plate 8 comprises a front plate upper part 8*a*, arranged on the upper part, and a front plate lower part 8*b* arranged on the lower part. The front plate upper part 8*a* is fixed to the outer side of the supports 5*b*, 5*c*. In addition, the front plate lower part 8*b* is fixed to the inner side of the two supports 5*b*, 5*c*, and the upper part is linked to the front plate upper part 8*a*, but is inclined so that it goes more to the inner side (rear side) of the case 2 as it goes downward from the upper end part.

The rear plate 9 is constituted substantially the same as the front plate 8, though the rear plate 9 is not clearly shown in the drawing. Mainly, the rear plate 9 comprises a rear plate upper part, which is formed at a position the same height as the front plate upper part 8*a*, and a rear plate lower part, which is formed at a position the same height as the front plate lower part 8*b*, and the rear plate lower part is inclined so that it goes more to the inner side (front side) of the case 2 as it goes downward. Furthermore, an opening is formed in the major part of the rear plate upper part, and is capable of an air inflow from the outside.

An opening is formed in the center part of the top plate 10, and a tubular bell mouth 15 is provided so that it covers this opening. Furthermore, a fan 16 is provided freely rotatable inside this bell mouth 15, and this fan 16 is constituted so that it is rotatably driven by a fan motor 17 arranged therebelow. Furthermore, the fan motor 17 is supported in the case 2 by a support frame, (not shown). In addition, a fan grille 18 is mounted at the upper opening of the bell mouth 15.

The case 2 constituted in this manner comprises an upper case part 2*a* formed by the front plate upper part 8*a* of the front plate 8, the rear plate upper part of the rear plate 9, and the portions of the ventilation parts 6, 7 that are arranged at a position the same height as the front plate upper part 8*a*. In addition, a lower case part 2*b* is formed by the front plate lower part 8*b* of the front plate 8, the rear plate lower part of the rear plate 9, and the portions of the ventilation parts 6, 7 that are arranged at a position the same height as the front plate lower part 8*b*. Further, as discussed earlier, because the front plate lower part 8*b* of the front plate 8 and the rear plate lower part of the rear plate 9 that constitute the lower case part 2*b* are inclined so that they are positioned just toward the inner side of the case as they go from the upper end to the lower end, the projected area of the lower case part 2*b* is comparatively smaller than the upper case part 2*a*, viewed from a plan view, excluding the boundary portion with the upper case part 2*a*.

The refrigerant circuit 3 principally has a heat exchanger 20, which is arranged at the upper part of the inside of the case 2; a compressor 21, which is fixed on the bottom plate 11 of the case 2; and various pipes linking these. The heat exchanger 20 is formed in a "U" shape viewed from a plan view, and is arranged along the left-right ventilation parts 6, 7 and the rear plate 9 of the case 2. The heat exchanger 20 exchanges heat between the air that flows in from the outside and the refrigerant. Further, the heat exchanger 20 is arranged at a height position corresponding to the front plate upper part 8*a* and the rear plate upper part, i.e., so that it is housed in the upper case part 2*a*. However, the compressor 21 is arranged at a height position corresponding to the front plate lower part 8*b* and the rear plate lower part, i.e., so that it is housed in the lower case part 2*b*.

(2) Installation

Figure 2:
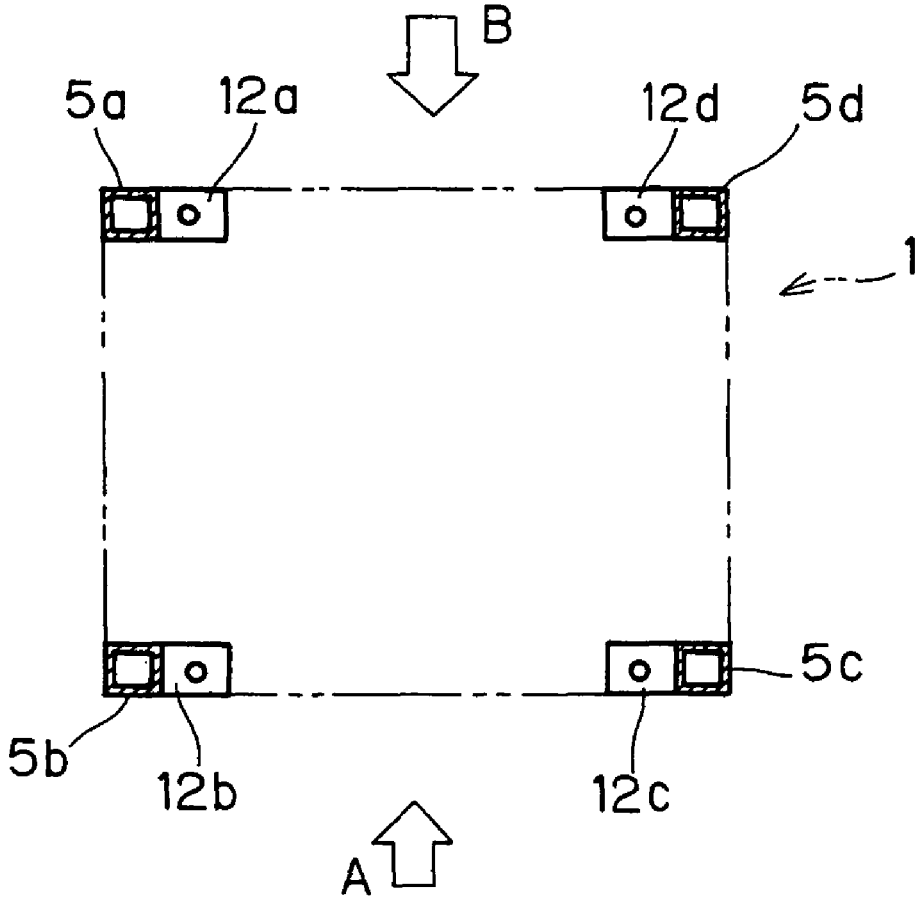
FIG. 2 is a schematic plan view that depicts the positional relationship of each of the foundation legs of the outdoor unit of the first embodiment.

When installing an outdoor unit 1 of the type described above, a worker positioned on the A side fixes the foundation legs 12*b*, 12*c* by chemical anchors, and the like, and, positioned on the B side, fixes the foundation legs 12*a*, 12*d* by chemical anchors, and the like, as shown in FIG. 2. Thus, because the two foundation legs 12*b*, 12*c* and the other foundation legs 12*a*, 12*d* are formed so that they are mutually opposing and approaching one another, the work of fixing two foundation legs can be performed from one location, and the work of fixing the four foundation legs can ultimately be performed from two locations.

Furthermore, when striking the chemical anchors, a space is required thereabove; however, because the front plate 8 and the rear plate 9 of the lower case part 2*b* (the front plate lower part 8*b* and the rear plate lower part) are inclined toward the inner side of the case as they go downward, a work space can be secured above each of the foundation legs 12*a*-12*d*, facilitating the work.

Figure 3:
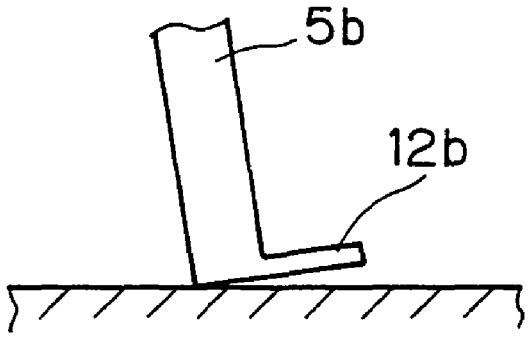
FIG. 3 is an external partial view that depicts an aspect when the outdoor unit of the first embodiment has been dropped.

In addition, when transporting or installing the outdoor unit 1, there are cases such as when the supports and the like collide with other members, or strike the ground due to being dropped. In a conventional apparatus, such a situation was hypothesized, and the plates of the foundation legs were made of a sufficient thickness to ensure strength so that they would not deform even when struck. However, in the present embodiment, because the foundation legs 12*a*-12*d* are provided so that they respectively extend toward the inner side of the case, even if, for example, the unit is dropped during installation, the support 5*b* hits the ground first, as shown in FIG. 3, thus preventing the foundation leg 12*b* from directly hitting the ground. In other words, the foundation leg is protected by this support. Consequently, it is preferable to ensure the strength of the foundation leg during fixing, the plate can be made thinner compared with a conventional foundation leg, and the cost can be reduced.

(3) Operation During Running

The following briefly explains the operation of the outdoor unit 1 that has been installed as described above.

During running of the outdoor unit 1, air flows in from the outside of the case 2 to the inside of the case 2, by the rotation of the fan 16, via the ventilation parts 6, 7 and via an opening in the rear plate 9. By passing through the heat exchanger 20, the heat of this air is exchanged with the refrigerant, and the heat exchanged air is discharged to the exterior of the case 2 via the bell mouth 15.

Herein, the heat exchanger efficiency depends greatly upon the heat exchanger surface area of the heat exchanger; however, in the present embodiment, the upper case part 2*a*, i.e., the space of the portion in which the heat exchanger 20 is housed, is comparatively the same space as in a conventional apparatus, and there is no change in the heat exchanger surface area of the heat exchanger 20. Accordingly, the heat exchanger efficiency does not suffer. Moreover, because the dead space of the lower case part 2*b* where the heat exchanger 20 is originally not arranged is eliminated, and the work space for fixing the foundation legs is secured, the installation work efficiency can be made satisfactory without causing a loss in the heat exchanger efficiency.

Second Embodiment

The following explains the second embodiment of the present invention based on the drawings.

(1) Constitution of the Outdoor Unit

Figure 4:
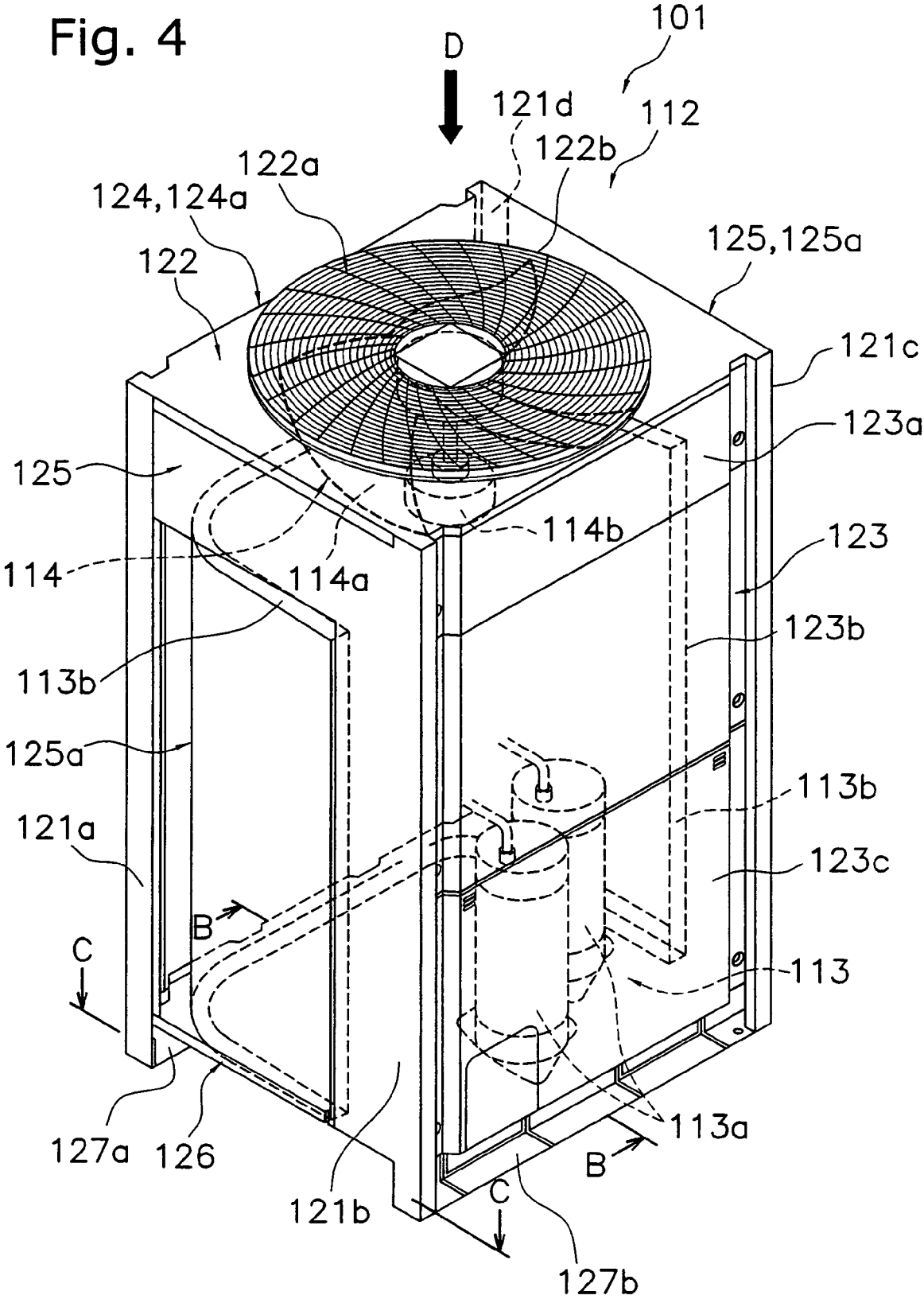
FIG. 4 is an external perspective view of the outdoor unit according to the second embodiment of the present invention.

FIG. 4 depicts an air conditioner outdoor unit 101 according to the second embodiment of the present invention. The outdoor unit 101 comprises a multi-type air conditioner, is installed on the roof of a building, and the like, and is connected to a plurality of indoor units via communicating pipes.

The outdoor unit 101 is a type that sucks in air from the side surface, exchanges heat, and then blows out air from the top surface, and is provided with a case 112, an outdoor refrigerant circuit 113 housed inside the case 112, and a ventilating fan 114 provided in the upper part of the case 112.

The case 112 is substantially a rectangular parallelepiped, and principally comprises supports 121*a*-121*d* respectively arranged at the four corners, a top plate 122, a front plate 123, a rear plate 124, a pair of side plates 125, and a bottom plate 126.

The supports 121*a*-121*d* are columnar members that extend vertically from the upper end to the lower end of each corner of the case 112, and fix and support the top plate 122, the front plate 123, the rear plate 124, the pair of side plates 125, and the bottom plate 126.

The top plate 122 has an air outlet 122*a* comprising an opening provided in the center thereof, and a fan grille 122*b* is provided so that it covers the upper part of the opening. Furthermore, it is constituted so that the air sucked into the case 112 blows out upward from the air outlet 122*a*.

The front plate 123 in the present embodiment comprises the upper front plate 123*a* arranged on the lower side of the top plate 122, a middle front plate 123*b* arranged on the lower side of the upper front plate 123*a*, and a lower front plate 123*c* arranged on the lower side of the middle front plate 123*b*. Thus, the front plate 123 has a structure with three partitions: upper, middle, and lower.

The rear plate 124 has an air inlet 124*a* for taking air into the case 112. In the present embodiment, the air inlet 124*a* comprises an opening provided substantially over the entire surface, the details of which are not shown. Each side plate 125, in a pair of side plates 125, has an air inlet 125*a* for taking air into the case 112. In the present embodiment, each air inlet 125*a* comprises an opening provided in the surface, excluding the vicinity of the front plate 123. Air is thus taken into the case 112 by these air inlets 124*a*, 125*a*.

The bottom plate 126 supports and fixes the equipment at various pipes that constitute the outdoor refrigerant circuit 113. In addition, the bottom plate 126 is supported by the four supports 121*a*-121*d* so that a space is created between the bottom plate 126 and the installation surface of the installation location.

Furthermore, foundation legs 127*a*, 127*b* are provided below the case 112 for fixing the case 112 to the installation location.

Figure 5:
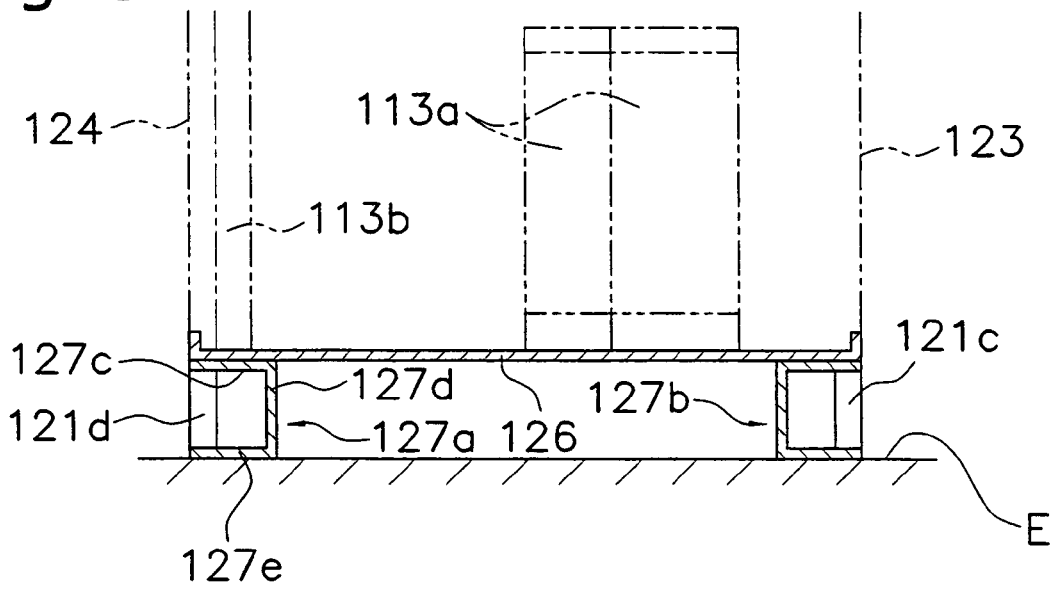
FIG. 5 is a simplified cross-sectional view taken along the B-B line in FIG. 4, and depicts the arrangement of the bottom plate, supports, and foundation legs from a side view.
Figure 6:
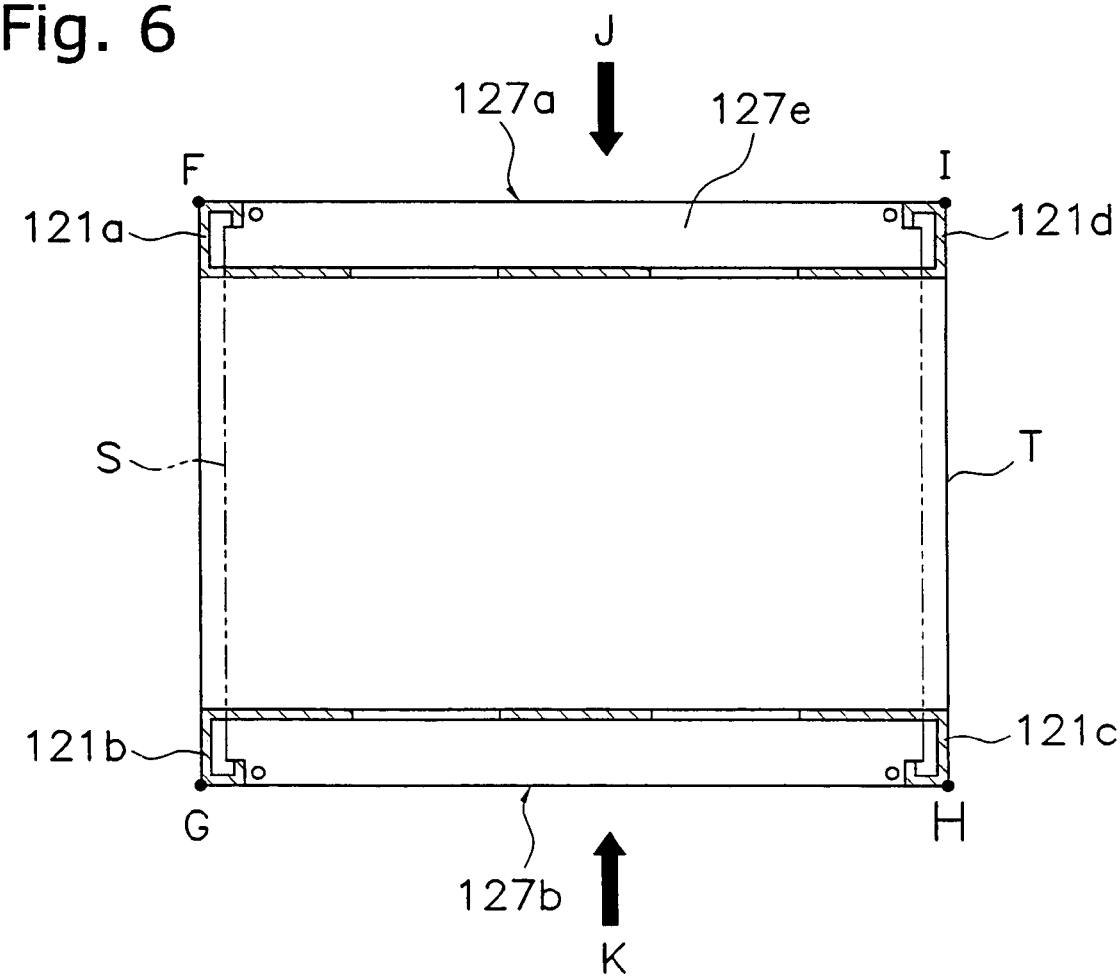
FIG. 6 is a simplified cross-sectional view taken along the C-C line in FIG. 4, and depicts the arrangement of the supports and the foundation legs in a plan view.
Figure 7:
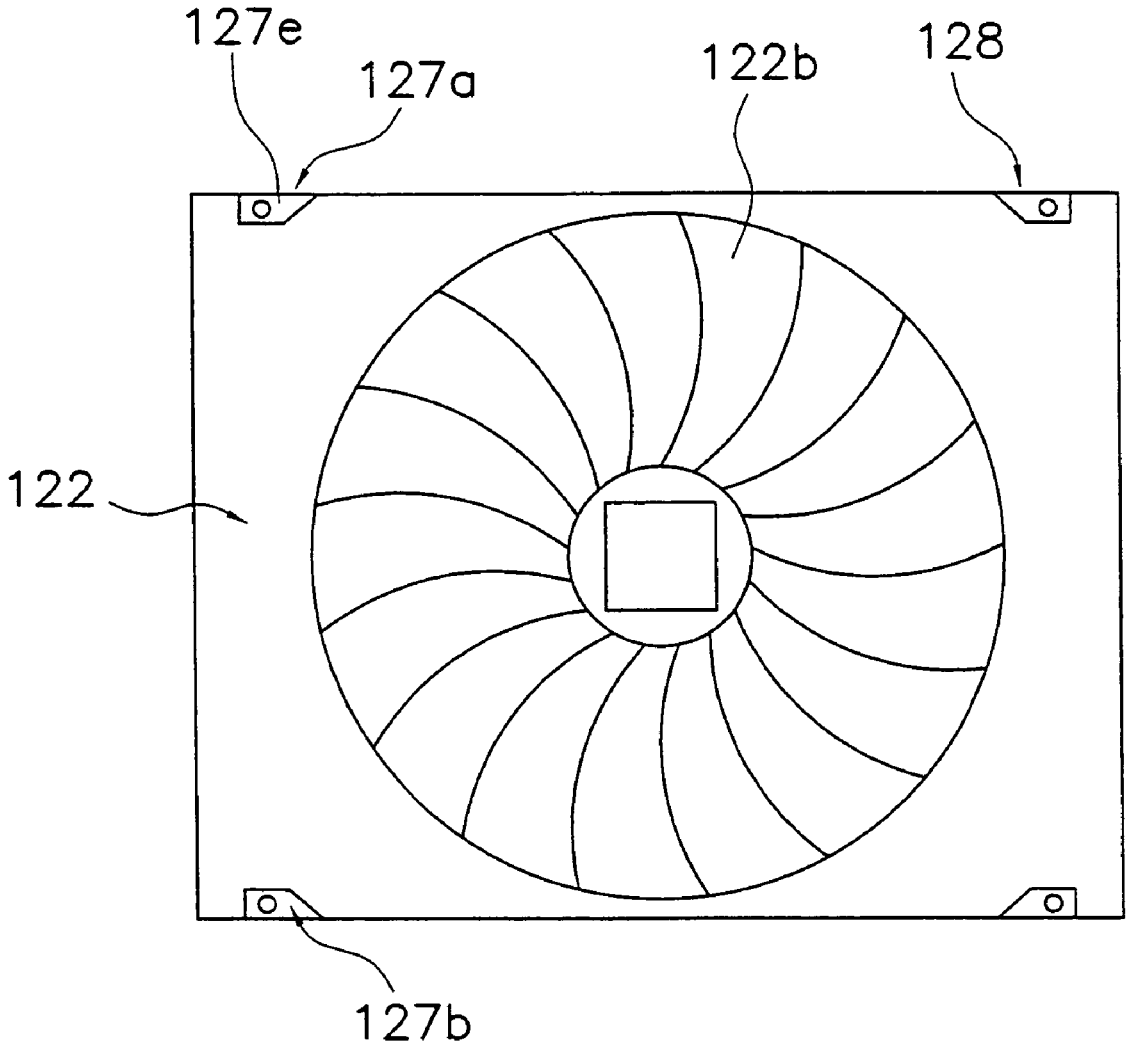
FIG. 7 is an auxiliary view taken from the D arrow in FIG. 4.

The following explains these foundation legs 127*a*, 127*b*, using FIG. 5 through FIG. 7. Herein, FIG. 5 is a cross-sectional view taken along the B-B line in FIG. 4, and depicts the arrangement of the bottom plate 126, the supports 121*c*, 121*d*, and the foundation legs 127*a*, 127*b*, seen from a side view. FIG. 6 is a cross-sectional view taken along the C-C line in FIG. 4, and depicts the arrangement, seen from a planar view, of the supports 121*a*-121*d* and the foundation legs 127*a*, 127*b*. FIG. 7 is an auxiliary view taken along the D arrow in FIG. 4.

In the present embodiment, the foundation legs 127*a*, 127*b* are U-shaped members that are fixed to the front plate 123 side and the rear plate 124 side of the lower surface of the bottom plate 126. Specifically, the foundation legs 127*a*, 127*b* comprise a plate-shaped bottom plate fixed part 127*c*, which is fixed to the lower surface of the bottom plate 126; a plate-shaped vertical part 127*d* that extends downward from the end part of the bottom plate fixed part 127*c* on the inner side of the case 112; and a plate-shaped mounting part 127*e* that extends from the lower end of the vertical part 127*d* toward the outer side of the case 112. The mounting part 127*e* is connected to the installation surface E of the installation location, and is fixed by an anchor and the like in a fixed hole formed in the mounting part 127*e*. Furthermore, the supports 121*a*-121*d* extend as far as the height position of the mounting part 127*e* of the foundation legs 127*a*, 127*b*.

The foundation leg 127*a* is formed so that it extends between the support 121*a* and a support 121*d*, viewed in a plan view of the case 112. Furthermore, fixed holes are respectively provided at the end parts on the supports 121*a*, 121*d* sides of the mounting part 127*e* of the foundation leg 127*a*. Namely, in a conventional outdoor unit, the foundation leg 127*a* is formed as an integrated unit with the foundation leg provided corresponding to the respective fixed holes. Likewise, a foundation leg 127*b* is formed so that it extends between a support 121*b* and a support 121*c*, viewed in a plan view of the case 112, and fixed holes are respectively provided at the end parts on the support 121*b*, 121*c* sides of the mounting part 127*e* of the foundation leg 127*b*.

In addition, as shown in FIG. 6, the substantially rectangular region formed by linking the peripheral edges, in a plan view, of the foundation legs 127*a*, 127*b* is included in the rectangular region T formed by successively linking the outer parts, in a plan view, of the supports 121*a*-121*d* (specifically, the points F, G, H, I). In other words, the foundation legs 127*a*, 127*b* are provided so that, in a plan view, they don't protrude outward from the case 112, which includes the supports 121*a*-121*d*.

Furthermore, in the case 112, a recessed part 128 that is recessed across the inner side of the case 112 is formed at a position corresponding to each fixed hole of the mounting parts 127*e* of the foundation legs 127*a*, 127*b*, viewed in a plan view as shown in FIG. 7, and is formed across the top plate 122, the front plate 123, and the bottom plate 126.

The outdoor refrigerant circuit 113 comprises a compressor 113*a*, a heat exchanger 113*b*, and the like, as well as various pipes that connect this equipment. The principle equipment, such as the compressor 113*a* and heat exchanger 113*b*, are fixed to the bottom plate 126. Namely, the equipment and pipes that constitute the outdoor refrigerant circuit 113 are principally arranged in the lower part of the case 112. The heat exchanger 113*b* is substantially U-shaped, and is arranged so that it opposes the three air inlets 124*a*, 125*a*. The heat exchanger 113*b* is capable of causing the exchange of heat between the refrigerant and the air taken in from the air inlets 124*a*, 125*a*.

The ventilating fan 114 is a propeller fan, and is arranged so that it corresponds to the air outlet 122*a*, in the upper part of the case 112. The ventilating fan 114 has an impeller 114*a*, and a fan motor 114*b* that rotatably drives the impeller 114*a*. The fan motor 114*b* is fixed to the case 112 via a support frame (not shown). More specifically, the ventilating fan 114 is arranged at a position corresponding to the position of the upper front plate 123*a* in the vertical direction. Thereby, the ventilating fan 114 can take in outside air through the air inlets 124*a*, 125*a* into the case 112 from the side of the case 112, which can pass through the heat exchanger 113*b*, and then can be guided to the upper part of the case 112 and blown out from the air outlet 122*a*.

(2) Installation

When installing an outdoor unit 101 of the type described above, a worker positioned on the J side fixes the foundation leg 127*a* by anchors, and the like, and, positioned on the K side, fixes the foundation leg 127*b* by anchors, and the like, as shown in FIG. 6. Thus, when striking the anchors, a space is required thereabove; however, because a recessed part 128 is respectively formed at a position corresponding to the fixed holes of the foundation legs 127*a*, 127*b* of the case 112, a work space can be secured above each of the foundation legs 127*a*, 127*b*, facilitating the work.

In addition, when transporting or installing the outdoor unit 101, there are cases such as when the supports and the like collide with other members, or strike the ground due to being dropped. In a conventional outdoor unit, such a situation was hypothesized, and the plates of the foundation legs were made of a sufficient thickness to ensure strength so that they would not deform even when struck. However, in the present embodiment, because the region S formed by the linking of the foundation legs 127*a*, 127*b* is included in the region T formed by the linking of the outer parts of the supports 121*a*-121*d*, even if, for example, the outside unit 101 is dropped during installation, the supports 121*a*-121*d* hit the ground first, thus preventing the foundation legs 127*a*, 127*b* from directly hitting the ground. In other words, the foundation legs 127*a*, 127*b* are protected by the supports 121*a*-121*d*. Consequently, it is basically preferable to ensure the strength of the foundation legs 127*a*, 127*b* during fixing, the plate can be made thinner compared with a conventional foundation leg, and the cost can be reduced.

Other Embodiments (a) The shape of the foundation legs and the direction in which they protrude is not limited to the above embodiments. For example, each foundation leg may be formed by protruding in respectively separate directions. Furthermore, although each foundation leg is formed as an integrated unit with the support in the first embodiment, a separate member may be provided that is fixed by welding to the support.

(b) In the first embodiment, the front plate lower part 8*b* and rear plate lower part in the lower case part 2*b* were made inclined surfaces so that their lower sides are inclined toward the inner side of the case; however, the shape of the lower case part is not limited to such a shape. It may be a shape that does not effect the arrangement of parts and the like housed inside, and that can ensure the space for the work of fixing the foundation leg.

(c) In the second embodiment, the foundation legs were provided as integrated members between the two supports; however, they may be provided for each of the four supports.

(d) As an example of an outdoor unit, a multi-type outdoor unit for buildings was cited, but the present invention may likewise be applied to an outdoor unit used in an air conditioner for a home.

INDUSTRIAL FIELD OF APPLICATION

By using the present invention, the foundation legs for fixing extend toward the inner side of the case at the lower end part of the supports and, therefore, the collision of the foundation legs with other members and the like can be prevented when transporting or installing the outdoor unit. Accordingly, the plates of the foundation leg can be made relatively thin, and costs can be reduced.

The invention claimed is:

1. An air conditioner outdoor unit comprising:

a case having a plurality of vertical strength parts extending substantially vertically, and a bottom part fixed to said vertical strength parts such that a bottom surface of said bottom part is spaced vertically upwardly from bottom ends of said vertical strength parts, said case housing an outdoor refrigerant circuit that includes a compressor, pipes, and a heat exchanger such that said outdoor refrigerant circuit is supported in said case at a location vertically above said bottom surface of said bottom part; and a plurality of foundation fixed parts being fixed to said bottom part of said case at support locations spaced from said vertical strength parts so that said foundation fixed parts are indirectly fixed to said vertical strength parts without said vertical strength parts intervening between said bottom part of said case and said foundation fixed parts, said foundation fixed parts having mounting parts that are configured to fix said case to an installation surface of an installation location located below said bottom surface of said bottom part of said case, said vertical strength parts extending in a downward direction relative to said bottom surface of said bottom part of said case to said bottom ends thereof, which are disposed at a height position of said mounting parts of said foundation fixed parts that are configured to fix the case to said installation surface of said installation location, and said foundation fixed parts being configured and arranged such that said foundation fixed parts do not protrude in an outward direction perpendicular to said downward direction and opposite a direction toward an inner side of said case from lower ends of said vertical strength parts.

2. The air conditioner outdoor unit as recited in claim 1, wherein said foundation fixed parts are fixed to said bottom surface of said bottom part of said case.

3. The air conditioner outdoor unit as recited in claim 1, wherein each of said foundation fixed parts is arranged between two of said vertical strength parts and formed as an integrated member.

4. The air conditioner outdoor unit as recited in claim 2, wherein each of said foundation fixed parts is arranged between two of said vertical strength parts and formed as an integrated member.

5. An air conditioner outdoor unit, comprising:

a case having a plurality of vertical strength parts extending substantially vertically, a plurality of plates disposed between said strength parts, and a bottom part fixed to said vertical strength parts such that a bottom surface of said bottom part is spaced vertically upwardly from bottom ends of said vertical strength parts, said case housing an outdoor refrigerant circuit that includes a compressor, pipes, and a heat exchanger; and a plurality of foundation fixed parts being fixed to said bottom part of said case at support locations spaced from said vertical strength parts so that said foundation fixed parts are indirectly fixed to said vertical strength parts without said vertical strength parts intervening between said bottom part of said case and said foundation fixed parts, said foundation fixed parts having mounting parts that are configured to fix said case to an installation surface of an installation location located below said bottom surface of said bottom part of said case, at least one of said plates having a portion vertically overlying a corresponding one of said foundation fixed parts, said case being configured and arranged to form a work space above a hole in each of said foundation fixed parts, said vertical strength parts extending in a downward direction relative to said bottom surface of said bottom part of said case to said bottom ends thereof, which are disposed at a height position of said mounting parts of said foundation fixed parts that are configured to fix the case to said installation surface of said installation location, and said foundation fixed parts being configured and arranged such that said foundation fixed parts do not protrude in an outward direction perpendicular to said downward direction and opposite a direction toward an inner side of said case from lower ends of said vertical strength parts.

6. The air conditioner outdoor unit as recited in claim 5, wherein said plates have a plurality of vertical recesses defining said work space at positions corresponding to each hole of said foundation fixed parts.

7. The air conditioner outdoor unit as recited in claim 5, wherein said mounting parts of said foundation fixed parts are visible when viewed in a downward direction from a position above an uppermost surface of said case.

8. The air conditioner outdoor unit as recited in claim 1, wherein said mounting parts of said foundation fixed parts are visible when viewed in a downward direction from a position above an uppermost surface of said case.

* * * * *